US007959480B2

(12) United States Patent
Lindblade

(10) Patent No.: US 7,959,480 B2
(45) Date of Patent: Jun. 14, 2011

(54) DETACHABLE MOORING AND FLUID TRANSFER SYSTEM

(75) Inventor: Stephen P. Lindblade, Waller, TX (US)

(73) Assignee: SOFEC, Inc., Houston, TX (US)

( * ) Notice: Subject to any disclaimer, the term of this patent is extended or adjusted under 35 U.S.C. 154(b) by 685 days.

(21) Appl. No.: 11/969,780

(22) Filed: Jan. 4, 2008

(65) Prior Publication Data

US 2008/0166936 A1 Jul. 10, 2008

Related U.S. Application Data

(60) Provisional application No. 60/878,954, filed on Jan. 5, 2007.

(51) Int. Cl.
*B63B 22/02* (2006.01)

(52) U.S. Cl. ..... 441/3; 114/230.12

(58) Field of Classification Search ..... 114/230.1, 114/293, 230.12; 441/3, 4, 5
See application file for complete search history.

(56) References Cited

U.S. PATENT DOCUMENTS 4,802,431 A 2/1989 Pollack
4,892,495 A 1/1990 Svensen
5,044,297 A 9/1991 de Baan et al.
5,065,689 A 11/1991 Krogstad
5,240,446 A * 8/1993 Boatman et al. ..... 441/3
5,305,703 A 4/1994 Korsgaard
5,316,509 A * 5/1994 Boatman et al. ..... 441/3
5,339,760 A 8/1994 Korsgaard
5,363,789 A 11/1994 Laurie et al.
5,372,531 A 12/1994 Boatman et al.
5,380,229 A 1/1995 Korsgaard
5,456,622 A 10/1995 Breivik et al.
5,468,166 A 11/1995 Breivik et al.
5,509,838 A 4/1996 Breivik et al.
5,529,521 A 6/1996 Breivik et al.
5,540,607 A 7/1996 Breivik et al.
5,545,065 A 8/1996 Breivik et al.
5,564,957 A 10/1996 Breivik et al.
5,628,657 A 5/1997 Breivik et al.
5,651,708 A 7/1997 B.o slashed.rseth
5,697,732 A 12/1997 Sigmundstad
5,749,758 A 5/1998 Breivik et al.
5,839,387 A 11/1998 Myklebust
5,913,279 A 6/1999 Braud et al.
5,941,746 A 8/1999 Isnard et al.
5,951,345 A 9/1999 Perratone et al.
5,957,074 A 9/1999 de Baan et al.
5,957,076 A 9/1999 Pollack et al.
5,983,931 A 11/1999 Ingebrigtsen et al.
6,053,787 A 4/2000 Erstad et al.
6,070,548 A 6/2000 Ducousso et al.
6,155,193 A 12/2000 Syvertsen et al.

(Continued)

*Primary Examiner* — Lars A Olson
(74) *Attorney, Agent, or Firm* — Gary L. Bush; Andrews Kurth LLP

(57) ABSTRACT

A mooring system comprising a submerged buoy releasably connected to a vessel adjacent its keel by a structural connector. The structural connector consists of a cylindrical sleeve coaxially movable with respect to a cylindrical housing by circumferential actuators. The lower ends of the connector sleeve and connector housing capture a number of collet segments circumpositioned therebetween that radially pivot in and out as the connector sleeve is moved axially within the connector housing. The lower ends of the collet segments extend downward to a connector hub on the buoy and releasably engage a groove therein, dogging the bearing hub against the vessel. A combined bearing assembly that supports both axial and radial loading revolvably connects the buoy to a moored chain table.

10 Claims, 14 Drawing Sheets

U.S. PATENT DOCUMENTS 6,164,233 A 12/2000 Pollack et al.
6,176,193 B1 1/2001 Whitby et al.
6,199,500 B1 3/2001 B.o slashed.rseth et al.
6,200,180 B1 3/2001 Hooper
6,250,243 B1 6/2001 Wierli et al.
6,269,762 B1 8/2001 Commandeur
6,302,048 B1 10/2001 Smedal
6,315,625 B1 11/2001 Braud
6,474,252 B1 11/2002 Delago
6,484,659 B2 * 11/2002 Hobdy et al. ..... 114/230.1
6,502,524 B1 1/2003 Hooper
6,517,290 B1 2/2003 Poldervaart
6,543,376 B1 4/2003 Egge et al.
6,595,154 B2 * 7/2003 Boatman ..... 441/3
6,701,981 B1 3/2004 Olsen
6,736,082 B2 5/2004 Breivik et al.
2004/0029464 A1 2/2004 Pollack et al.
2007/0264889 A1 11/2007 Boatman et al.

* cited by examiner

DETACHABLE MOORING AND FLUID TRANSFER SYSTEM

CROSS REFERENCE TO RELATED APPLICATION

This application claims priority from Provisional Application 60/878,954 filed Jan. 5, 2007.

BACKGROUND OF THE INVENTION

1. Field of the Invention

This invention concerns detachable mooring systems for loading and offloading liquid petroleum product oil tankers, floating storage (FSO) vessels, floating production storage and offloading (FPSO) systems, floating vessels for natural gas offloading (for example, a cryogenic liquefied natural gas (LNG) regas import terminal), and LNG transport vessels.

2. Description of the Prior Art

Numerous patents are known that pertain to disconnectable mooring systems, most of which utilize a submerged buoy that can be detachably released from a floating vessel. For example, U.S. Pat. No. 5,651,708 issued to Borseth shows a detachable buoy with a geostationary part. The Borseth buoy has an outer body that is received in a recess in the bottom of the vessel, where the outer body is fixed to the vessel by locking wedges. Four other notable types of detachable mooring systems are known and are illustrated in FIGS. 1 to 4.

FIGS. 1A and 1B illustrate a disconnectable mooring system of a design of FMC Technologies and as illustrated by U.S. Pat. No. 5,240,446. The mooring system has two basic parts: a geostationary buoy 61 and a detachably connectable turret assembly 53 that is disposed in the floating vessel. The buoy 61 is moored to the seabed by a number of anchor legs 63 that are connected to the buoy at anchor leg connectors 62, such that the buoy is generally geostationary when the anchor legs 63 are anchored to the sea floor.

The vessel 52 carries a turret assembly 53, which is rotatively mounted within the vessel hull and which opens to the sea near the keel elevation. The turret 53 includes a vertical turret shaft 59 and is supported by an upper axial bearing 57 and a lower radial bearing 58. The turret and bearings remain on the vessel when the buoy is disconnected therefrom. The lower end of the turret shaft 59 is equipped with a structural connector 60 that is designed and arranged to disengageably connect with a connector hub 66 mounted at the upper surface of the buoy 61. Rubber fenders 64 are provided on the buoy to cushion the mooring process. A water seal 67 is provided to maintain watertight integrity of the turret compartment in the vessel.

The turret mooring arrangement of FIGS. 1A and 1B provides a fluid flow path between a subsea well or component and the vessel when the vessel is moored to the buoy. The fluid transfer system (FTS) 54 includes a flexible conductor 68 spanning the distance between the seabed and the buoy 61, a lower conductor pipe 56*a* that is geostationary and in fluid communication with the flexible conductor 68, and an upper conductor pipe 56*b*, which is fixed to the vessel and in fluid communication with the lower conductor pipe 56*a* via a fluid swivel 55.

When the buoy 61 is completely separated from the vessel 52, the buoy 61 is designed and arranged to sink to a neutrally buoyant position about 36 meters below sea level. As shown in FIG. 1B, the vessel is connected to the buoy by first recovering the submerged buoy upwards to the structural connector 60 by heaving in a retrieval line 65 with a winch system (not shown). The structural connector 60 is then locked in engagement with the connector hub 66, fixing the turret with the geostationary buoy and mooring the vessel 52 to the seabed. The vessel can freely weathervane about the geostationary turret in response to wind, waves and currents.

FIGS. 2A and 2B show a later version of a disconnectable turret mooring arrangement 71 design of FMC Technologies. The turret mooring arrangement 71 of FIGS. 2A and 2B is substantially similar to the turret mooring arrangement 51 of FIGS. 1A and 1B. For example, the buoy 81 is moored to the seabed by a number of anchor legs 83 that are connected to the buoy at anchor leg connectors or cars 82, such that the buoy is generally geostationary. The vessel 72 carries a turret assembly 73, which is revolvably disposed within the vessel hull and which opens to the sea near the keel. The turret assembly 73 includes a vertical turret shaft 79 which is supported by an upper axial bearing 77 and a lower radial bearing 78. The turret and bearings remain on the vessel when the buoy is disconnected. The lower end of the turret shaft 79 is equipped with a structural connector 80 that is designed and arranged to disengageably connect to a connector hub 86 disposed at the upper surface of the buoy 81. A water seal 87 is provided to maintain watertight integrity of the turret compartment in the vessel. The fluid transfer system (FTS) 74 includes a flexible conductor 88 between the seabed and the buoy 81, a lower geostationary conductor pipe 76*b* in fluid communication with the flexible conductor, and an upper conductor pipe 76*a*, fixed to the vessel and in fluid communication with the lower conductor pipe 76*b* via a fluid swivel 75. When the buoy 81 disconnects from the vessel 72, the buoy 81 is of a design so that it sinks to a neutrally buoyant position about 36 meters below sea level. A retrieval line 85 is provided for heaving the buoy to the vessel.

However, unlike the turret mooring arrangement of FIGS. 1A and 1B, where the buoy 61 abuts the keel of the moored vessel 52, in the arrangement of FIGS. 2A and 2B, the upper part of a buoy 81 is cone shaped and is brought into a cone shaped buoy receiving space 89. The structural connector 80 fastens the buoy 81 to the turret shaft 79. The turret shaft 79 is rotatively connected to the vessel 72 by the upper bearing 77. The skirt 90 is rotatively coupled to the lower bearing 78. This system is advantageous when several large fluid conductors 88 are required.

FIGS. 3A and 3B generally describe a subsurface buoy mooring system 101 such as that shown by Svensen in U.S. Pat. No. 4,892,495. A cone-shaped buoy 103 is rotatively received into a receptacle 108 formed in the vessel hull 111 and is secured inside a complementary turret receptacle 104 by latches 105. A radial bearing 106 and a vertically-oriented axial bearing 107 support turret 102. The axial bearing 107 abuts a bearing support surface 110. When the buoy 103 is disconnected from the vessel, the turret and the bearings remain on the vessel. The buoy 103 is moored to the seabed by a number of anchor legs 109 such that the buoy is essentially geostationary. For simplicity, the fluid transfer system is not illustrated.

FIGS. 4A and 4B illustrate a type of mooring system 121 design of Advanced Production Loading (APL) AS of Norway and described in U.S. Pat. No. 5,468,166, among others. A buoy assembly 124 includes a buoy 128, upper and lower bearings 126, 127, and a turret 125 that is rotatably supported by the bearings. The cone-shaped buoy 128 is non-rotatably secured into a complementary receptacle 137 formed in the vessel hull 122 by latches 134 that engage a groove 135 formed in the buoy.

The fluid transfer system (FTS) includes a flexible conductor 133 spanning the distance between the seabed and the buoy 128, a lower conductor pipe 132 that is geostationary and in fluid communication with the flexible conductor, and an upper conductor pipe 136, which is fixed to the vessel and in fluid communication with the lower conductor pipe 132 via a fluid swivel 123.

However, the buoy 128 is not geostationary. The buoy is attached to and rotates with the vessel hull 122 while the turret 125 remains geostationary. When the buoy assembly 124 is disconnected from the vessel 122, the bearings 126, 127 and the turret 125 remain on the buoy. The lower end of the turret 125 includes a chain table or anchor leg frame 129 with anchor leg connectors or ears 131. A number of anchor legs 130 connect the chain table 129 and turret 125 to the seabed so that the turret 125 is essentially geostationary. In this design the entire anchor leg system weight and loads are supported by the axial bearing 126. Because the buoy 128 rotates, it does not serve to reduce vertical bearing loads.

Most mooring systems are "turret" systems of one form or another which are familiar to the art of mooring design. Turrets are generally large and expensive structures that usually include large diameter upper and lower bearings. Many prior art disconnectable mooring systems also require a large (approximately 10 meters diameter or larger cone shaped opening in the vessel bottom. Such structure mandates expensive vessel construction.

Accordingly there is a need for a new design to reduce the cost of mooring structures. Furthermore, large openings in the vessel hull to accommodate mooring buoys cause significant drag and energy losses on those disconnectable cargo vessels required to said long distances. Because newer and larger high speed LNG carrier/regas vessels tend to have a narrow flat bottom near the bow at the optimum location for a buoy connection, a large hull opening is a less desirable in these applications.

3. Identification of Objects of the Invention

A primary object of this invention is to provide a detachable mooring system that does not require a turret for connection between a vessel and a mooring buoy, but rather provides a connector flange between a vessel mounted hydraulic connector and the buoy, with an axial/radial bearing assembly between the buoy and a chain table secured to the sea floor.

Another object of this invention is to provide a detachable mooring system having a buoy supported on a chain table with a bearing assembly with a relatively large radial dimension as compared to prior art arrangements so that a large radial mooring load capacity is achieved. Detachable moorings having larger radial load capacity are desirable because hydrocarbon production and import/export terminals are required in more hostile environments than in the past.

Another object of the invention is to provide a mooring system that requires a significantly smaller opening in the vessel that includes the capability to plug the opening so that a virtually smooth ship bottom is achieved at the buoy connection point.

Another object of the invention is to provide an improved detachable mooring system including buoy-to-ship interface equipment that can be released and recovered in high sea states and harsh conditions.

SUMMARY OF THE INVENTION

The objects identified above, as well as other features and advantages of the invention are incorporated in a mooring and fluid transfer system including a submergible buoy that is rotatively mounted to a chain table moored to the sea floor so as to be generally geostationary. The buoy is detachably releasable from a floating vessel. The buoy mounts adjacent the bottom of the vessel rather than having a substantial portion of the buoy being received into the vessel as in the prior art arrangements FIGS. 2-4. The buoy and vessel connected thereto freely weathervane about the geostationary chain table.

A combined bearing assembly that supports axial and radial loading is mounted between the buoy and chain table, rather than in the vessel as disclosed by the prior art FIGS. 1-3. A cylindrical bearing ring, which forms an outer race of a bearing assembly, is mounted to the bottom of the buoy. A cylindrical bearing hub forms the inner race of the bearing assembly and is fastened to the geostationary chain table with bolts.

The buoy is releasably connected to the bottom of the vessel by a structural connector mounted on the vessel. The structural connector includes a cylindrical connector sleeve coaxially disposed in a cylindrical connector housing. The connector sleeve is movably coupled to the connector housing by actuators circumferentially disposed between the sleeve and the housing so that the sleeve can axially slide with respect to the housing. The lower ends of the connector sleeve and connector housing capture a number of collet segments circumpositioned therebetween that radially pivot in and out as the inner connector sleeve is moved axially up and down within the connector housing, respectively.

To connect the mooring buoy to the vessel, a connector flange mounted to the buoy is placed axially adjacent to the bottom of the connector housing of the vessel's structural connector. The lower ends of the collet segments extend downwardly next to the connector flange. The connector sleeve is moved downwardly by the actuators, which force the collet segments to pivot radially toward the connector flange. The ends of the collet segments then engage a groove in the connector flange, thus dogging the connector flange (and the buoy) against the connector housing of the vessel.

BRIEF DESCRIPTION OF THE DRAWINGS

The invention is described in detail hereinafter on the basis of the embodiments shown in the accompanying figures, in which.

DESCRIPTION OF THE PREFERRED EMBODIMENTS OF THE INVENTION

Figure 5A:
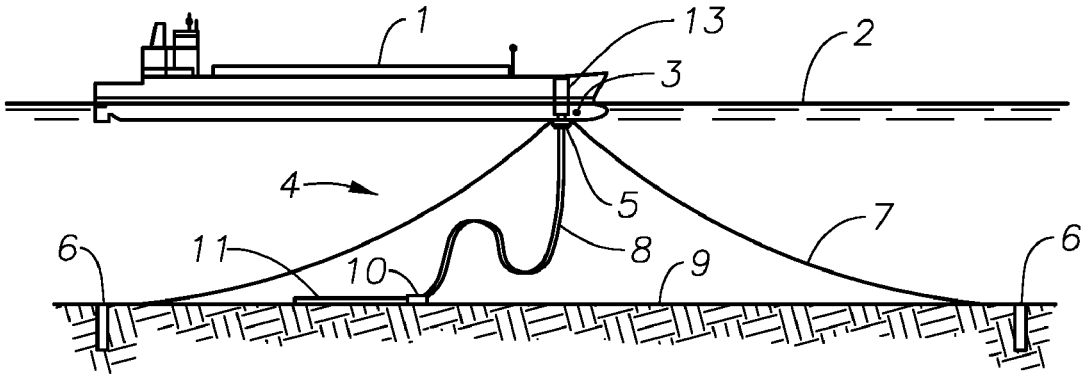
FIG. 5A is a side view of a floating cargo tanker ship moored to a disconnectable geostationary buoy according to an embodiment of the invention.
Figure 5B:
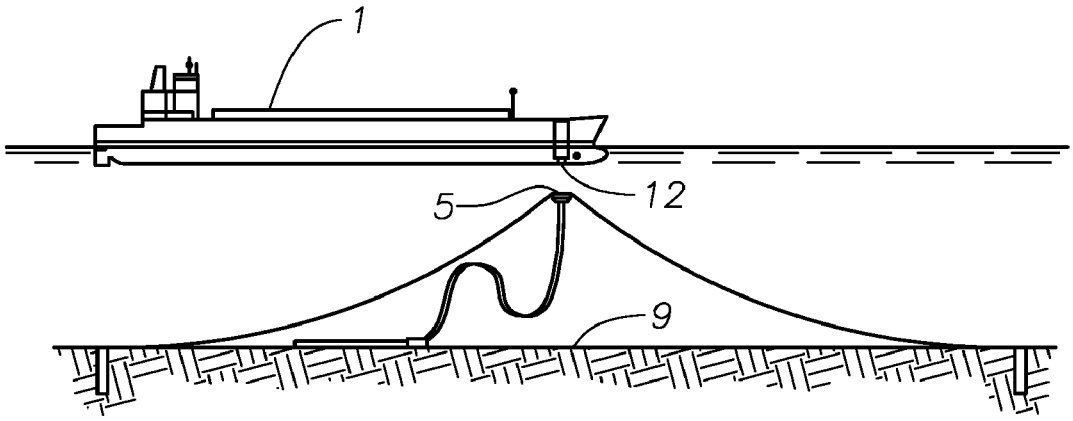
FIG. 5B is a side view of the cargo tanker ship of FIG. 5A disconnected from the buoy of FIG. 5A.

FIGS. 5A and 5B illustrate an embodiment of the invention used for mooring a cargo tanker ship 1 that is adapted for transporting liquid or pressurized gas hydrocarbon products. Tanker 1 typically requires frequent connection and disconnection from the mooring system and may be equipped with bow thrusters 3 to aid the recurring mooring process.

Mooring system 4, includes a buoy 5 that is detachably connectable to a structural connector 12 that is mounted to the bottom of the vessel 1. The system 4 is adapted to temporarily moor the vessel, allowing the vessel to weathervane around the point of mooring under the influence of wind, waves and currents while it is being loaded. Mooring system 4 preferably includes a number of anchors 6 and anchor legs 7 that moor buoy 5 to the sea floor 9 so that the buoy is essentially geostationary.

The structural connector 12, fixed to vessel 1, is locked in axial engagement with the buoy but is free to rotate about the geostationary chain table on the buoy. Mooring arrangement 4 provides a fluid flow path between a subsea well, pipeline, or component and the vessel when the vessel is moored to the buoy. The cargo is transported to or from vessel 1 by pipeline 11 on seafloor 9, pipeline end manifold (PLEM) 10, flexible conductor 8, and fluid transfer system 13, located on ship 1. However, other fluid flow path arrangements may be used as appropriate.

Figure 1B:
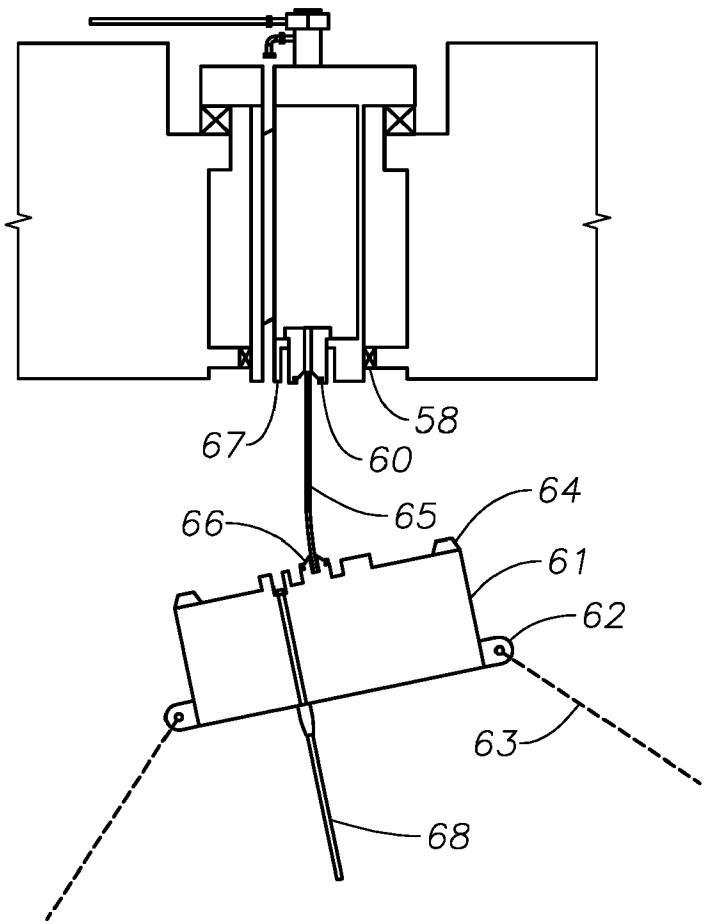
Fig. 1B (Prior Art)
FIG. 1B is a side view in partial cross section of the prior art disconnectable mooring system of FIG. 1A showing the mooring buoy disconnected from the vessel but in the process of being hauled in for connection to a turret.
Figure 1A:
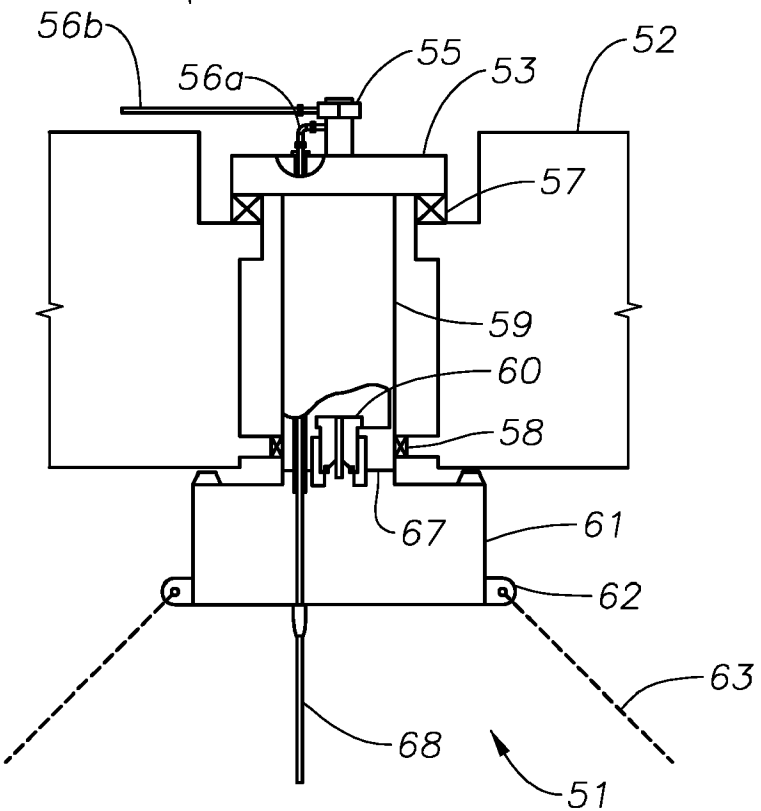
Fig. 1A (Prior Art)
FIG. 1A is a side view in partial cross section of a disconnectable mooring system of a prior art arrangement showing a mooring buoy connected to a turret which is rotatively supported on a vessel and connected to a fluid transfer system.
Figure 2B:
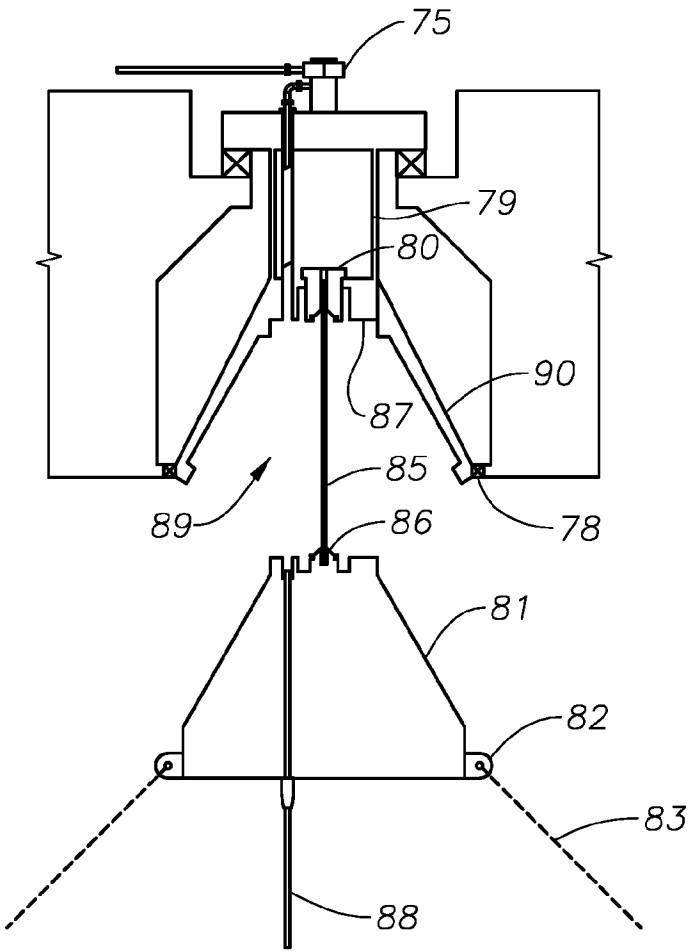
Fig. 2B (Prior Art)
FIG. 2B is a side view in partial cross section of the prior art disconnectable mooring system of FIG. 2A showing the mooring buoy disconnected from the vessel in the process of being hauled in for connection to a turret.
Figure 2A:
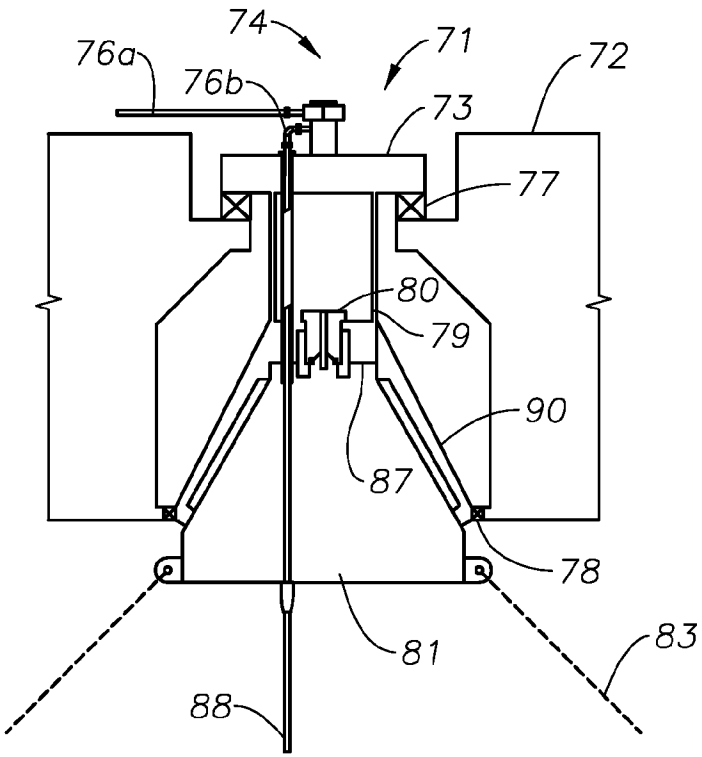
Fig. 2A (Prior Art)
FIG. 2A is a side view in partial cross section of a later prior art disconnectable mooring system showing a mooring buoy connected to a vessel mounted turret and a fluid transfer system.
Figure 3B:
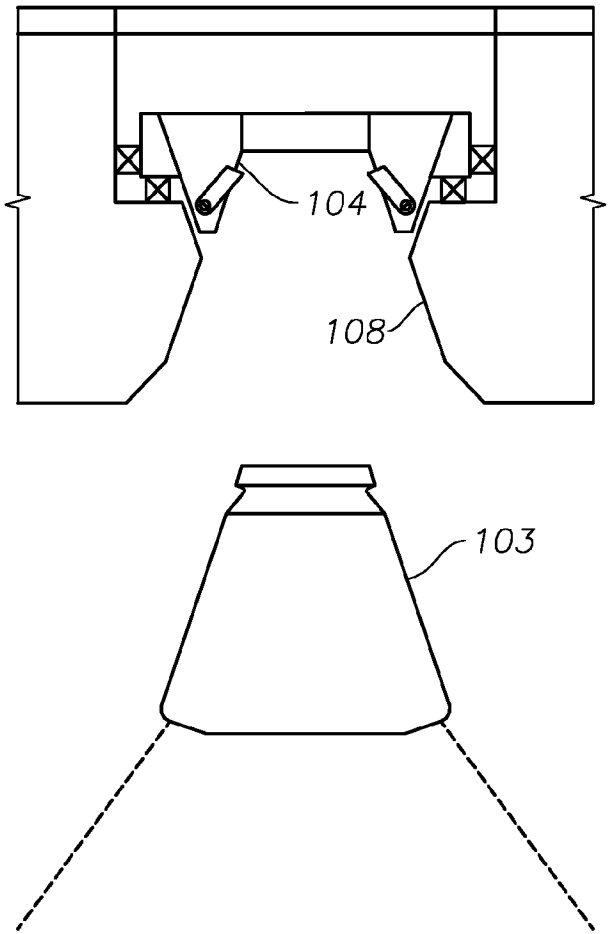
Fig. 3B (Prior Art)
FIG. 3B is a side view in partial cross section of the prior art disconnectable subsurface buoy mooring system of FIG. 3A showing the mooring buoy disconnected from the vessel.
Figure 3A:
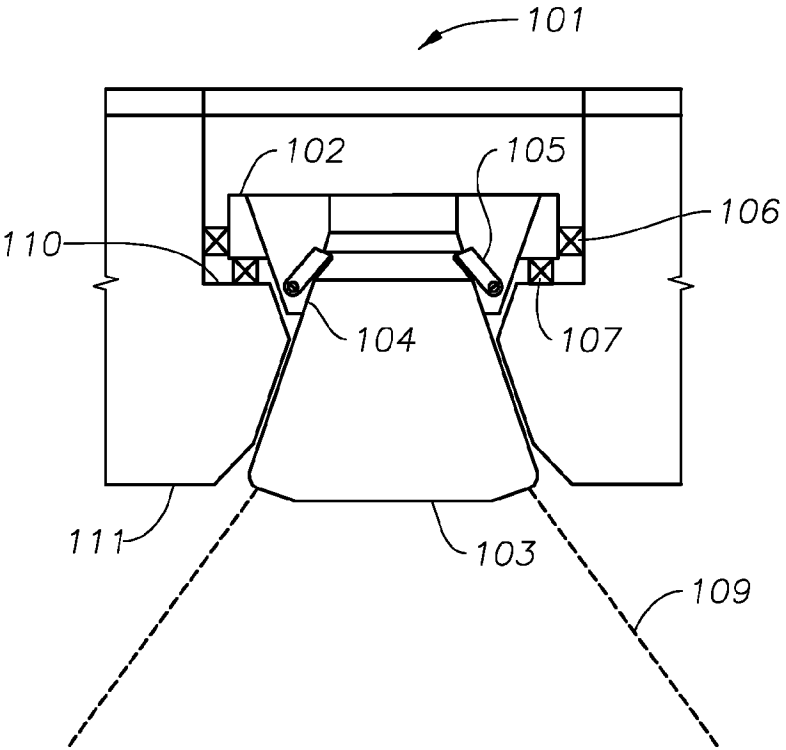
Fig. 3A (Prior Art)
FIG. 3A is a side view in partial cross section of another prior art disconnectable subsurface buoy mooring system showing a mooring buoy connected to a vessel mounted turret.
Figure 4B:
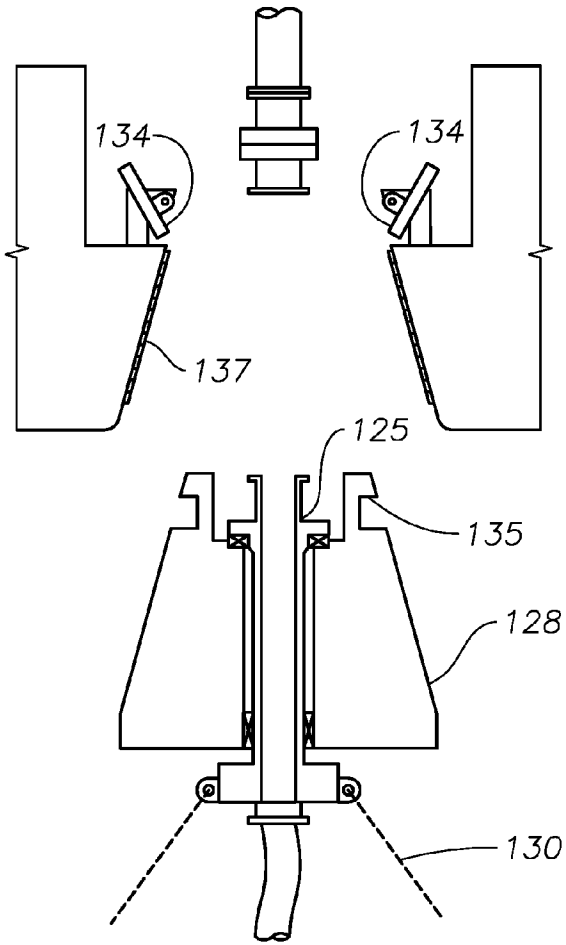
Fig. 4B (Prior Art)
FIG. 4B is a side view in partial cross section of the prior art disconnectable mooring system of FIG. 4A showing the mooring buoy disconnected from the vessel.
Figure 4A:
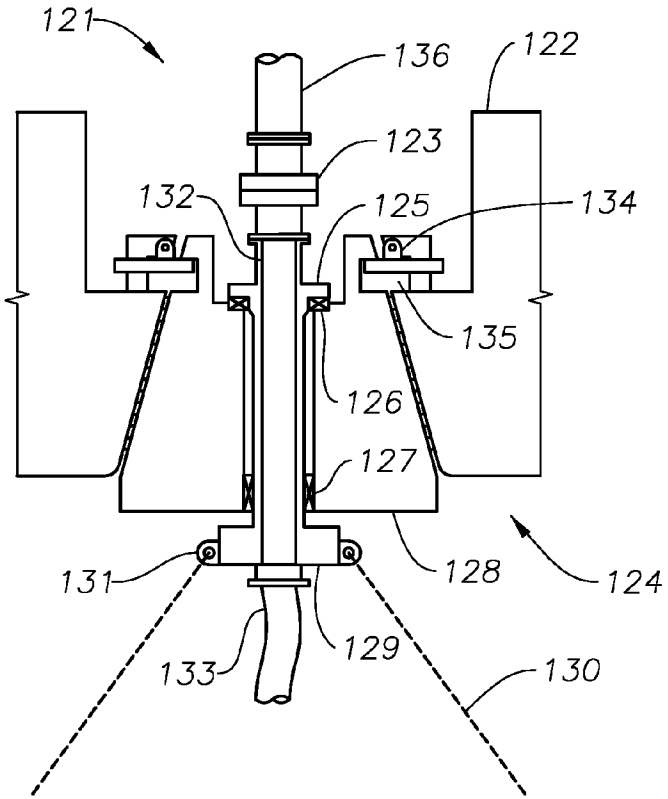
Fig. 4A (Prior Art)
FIG. 4A is a side view in partial cross section of a prior art disconnectable mooring system showing a mooring buoy with an a turret carried by the buoy and with a mechanism for connecting the vessel to the buoy.

FIG. 5B shows vessel 1 disconnected from buoy 5. Structural connector 12 remains on the vessel. When the buoy 5 is completely detached from the vessel 1, the buoy 5 is designed and arranged to sink to a neutrally buoyant position about 36 meters below sea level 2. Unlike the mooring arrangements of FIGS. 1-3, the vessel 1 used with mooring system 4 does not carry a turret assembly rotatively disposed within the vessel hull. Neither axial bearings nor radial bearings remain on the vessel when the buoy is disconnected therefrom, because an axial/radial bearing assembly is carried by the buoy and provides rotation between buoy 5 and a chain table.

Figure 6A:
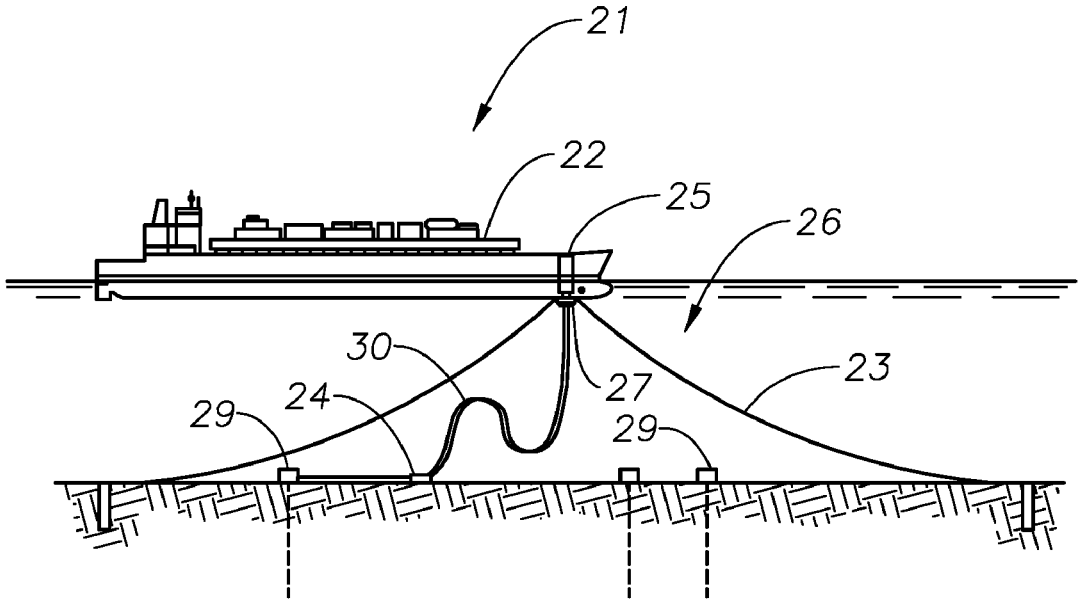
FIG. 6A is a side view of a floating production system moored by a detachable buoy according to an embodiment of the invention.
Figure 6B:
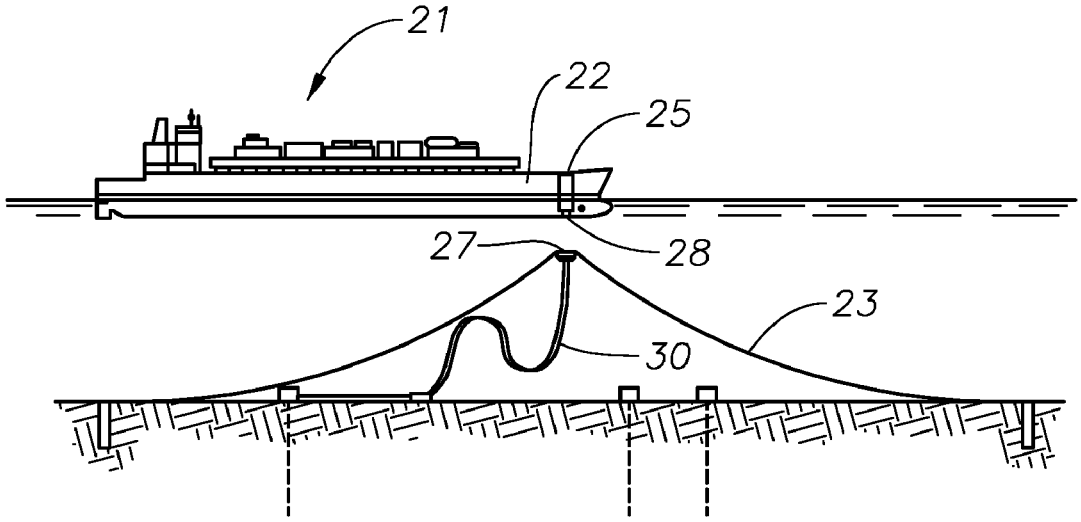
FIG. 6B is a side view of the floating production system of FIG. 6A disconnected from the buoy of FIG. 6A.

FIGS. 6A and 6B illustrate an embodiment of the invention used for mooring a floating production, storage, and offloading (FPSO) vessel 22. A production system 21 may be installed on vessel 22. The system of FIGS. 6A and 6B does not require frequent or rapid disconnection from the buoy. Disconnect and reconnect operations of this type system are generally performed in less harsh water conditions in order to evade an approaching storm or iceberg. Additional advantages of less construction time, less capital expense, and rapid offshore installation of the mooring system as compared to prior mooring systems are provided by the invention.

Mooring system 26, including a buoy 27 that is detachably connectable to a structural connector 28 mounted to the bottom of the vessel 22, is arranged to moor the vessel thereby allowing the vessel to weathervane around the point of mooring under the influence of wind, waves and currents. Mooring system 26 includes a plurality of anchors and anchor legs 23 that moor buoy 27 to the sea floor so that the chain table on the buoy is essentially geostationary.

In FIG. 6A, the structural connector 28, fixed to vessel 22, is locked in axial engagement with the buoy but is free to rotate about the geostationary buoy. Mooring arrangement 26 provides a fluid flow path between a subsea well 29 and the vessel when the vessel is moored to the buoy. Fluid is transported to FPSO 22 from the subsea well by a subsea manifold 24, flexible conductor 30 and fluid transfer system 25, located on FPSO 22. However, multiple fluid flow path arrangements may be provided as appropriate.

FIG. 6B shows FPSO 22 disconnected from buoy 27. Structural connector 28 remains on the ship 22. When the buoy 27 is completely detached from the ship 22, the buoy 27 is designed and arranged to sink to a neutrally buoyant position about 36 meters below sea level. Unlike the mooring arrangements of FIGS. 1-3, the vessel 22 used with mooring system 26 does not carry a turret assembly revolvably disposed within the vessel hull. Neither axial bearings nor radial bearings remain on the vessel when the buoy is disconnected therefrom.

Figure 7A:
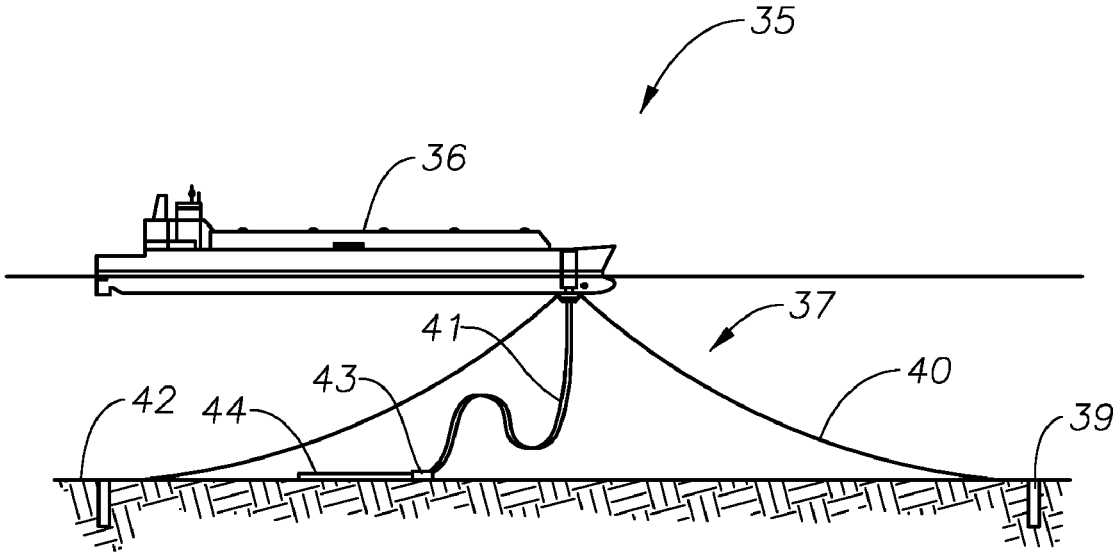
FIG. 7A is a side view of a floating LNG import/export terminal moored to a disconnectable geostationary buoy according to an embodiment of the invention.
Figure 7B:
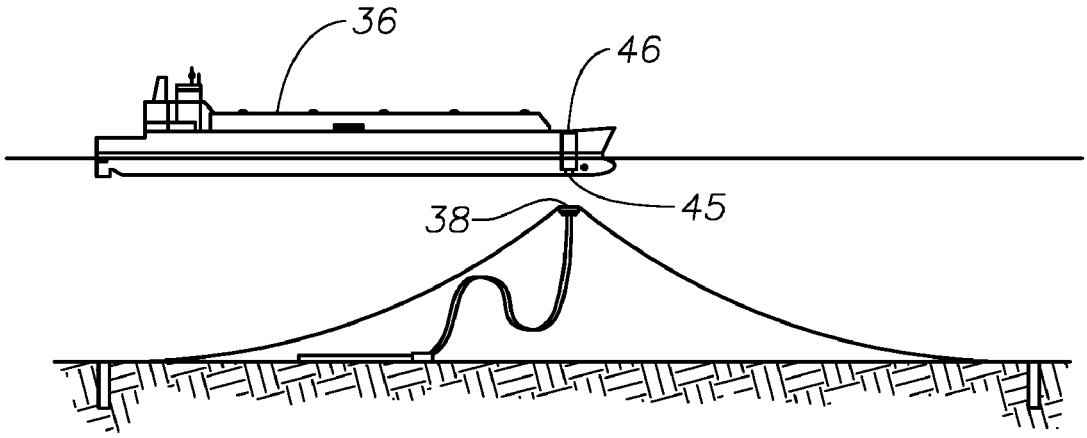
FIG. 7B is a side view of the LNG import/export terminal of FIG. 7A disconnected from the buoy of FIG. 7A.

FIGS. 7A and 7B illustrate an embodiment of the invention used with an LNG import/export terminal 35 including an LNG regas ship 36 that loads or offloads LNG cargo through flexible conductor 41. Mooring system 37, includes a buoy 38 that is detachably connectable to a structural connector 45 mounted to the bottom of the vessel 36, and is adapted to moor the vessel, allowing the vessel to weathervane around the point of mooring under the influence of wind, waves and currents. Mooring system 37 preferably includes a number of anchors 39 and anchor legs 40 that moor buoy 38 to the sea floor 42 so that the chain table on the buoy is essentially geostationary.

In FIG. 7A, the structural connector 45, fixed to vessel 36, is locked in axial engagement with the buoy but is free to rotate about the geostationary chain table on the buoy. Mooring arrangement 37 provides a fluid flow path between a pipeline or component and the vessel when the vessel is moored to the buoy. Fluid is transported to or from LNG carrier ship 36 by pipeline 44 on seafloor 42, PLEM 43, flexible conductor 41, and fluid transfer system 46, located on vessel 36. However, other fluid flow path arrangements may be used as appropriate.

FIG. 7B shows LNG carrier ship 36 disconnected from buoy 38. Structural connector 45 remains on the ship 26. When the buoy 38 is completely detached from the ship 36, the buoy 38 is designed and arranged to sink to a neutrally buoyant position about 36 meters below sea level. Unlike the mooring arrangements of FIGS. 1-3, the vessel 36 used with mooring system 37 does not carry a turret assembly revolvably disposed within the vessel hull. Neither axial bearings nor radial bearings remain on the vessel when the buoy is disconnected therefrom.

Figure 8A:
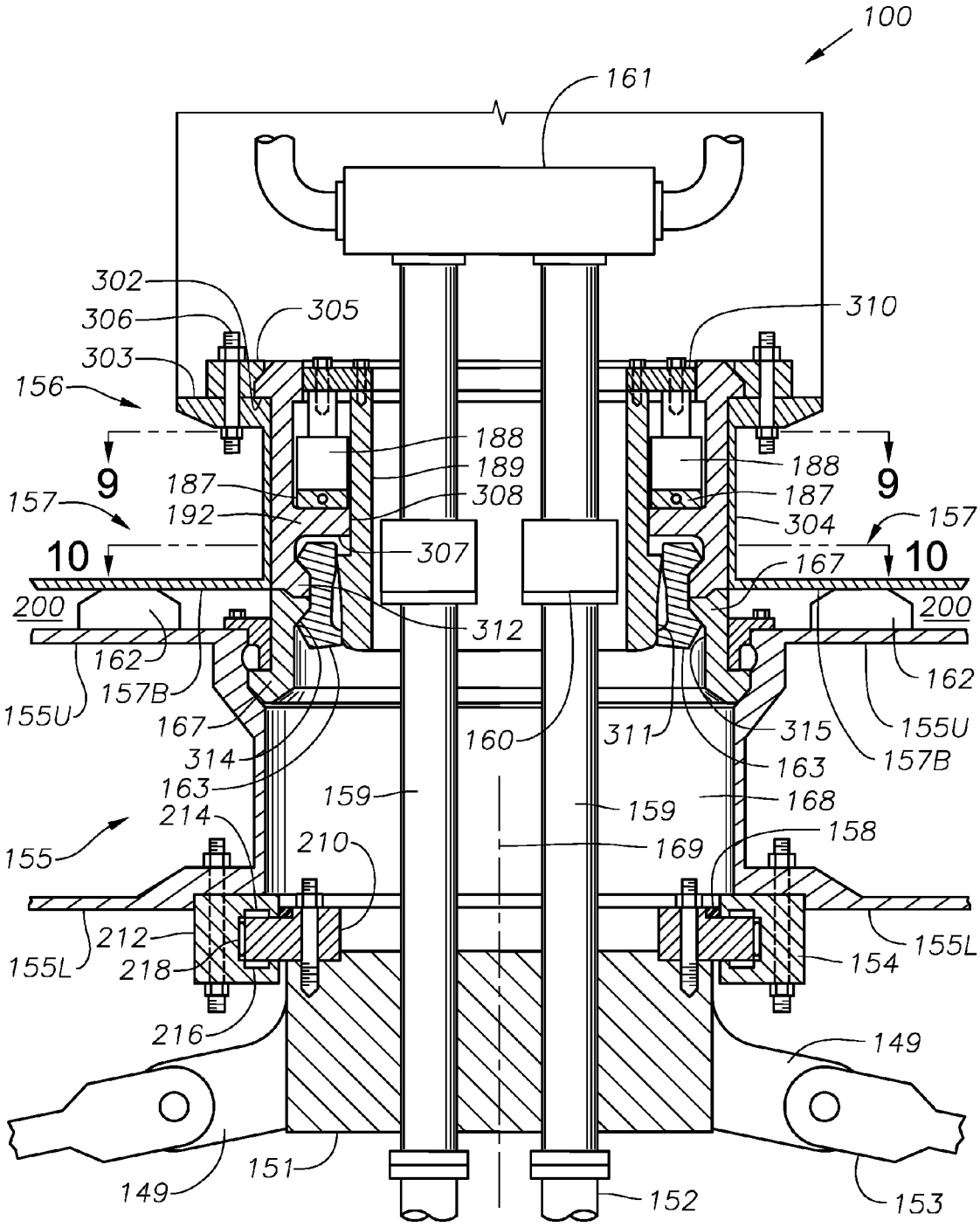
FIG. 8A is a side view in partial cross section of a mooring and fluid transfer system according to a preferred embodiment of the invention, connected to a floating vessel and showing a structural connector on board the vessel, a connector flange at the top of the mooring buoy, and an axial/radial bearing arrangement providing rotative support between the buoy and a chain table.
Figure 8B:
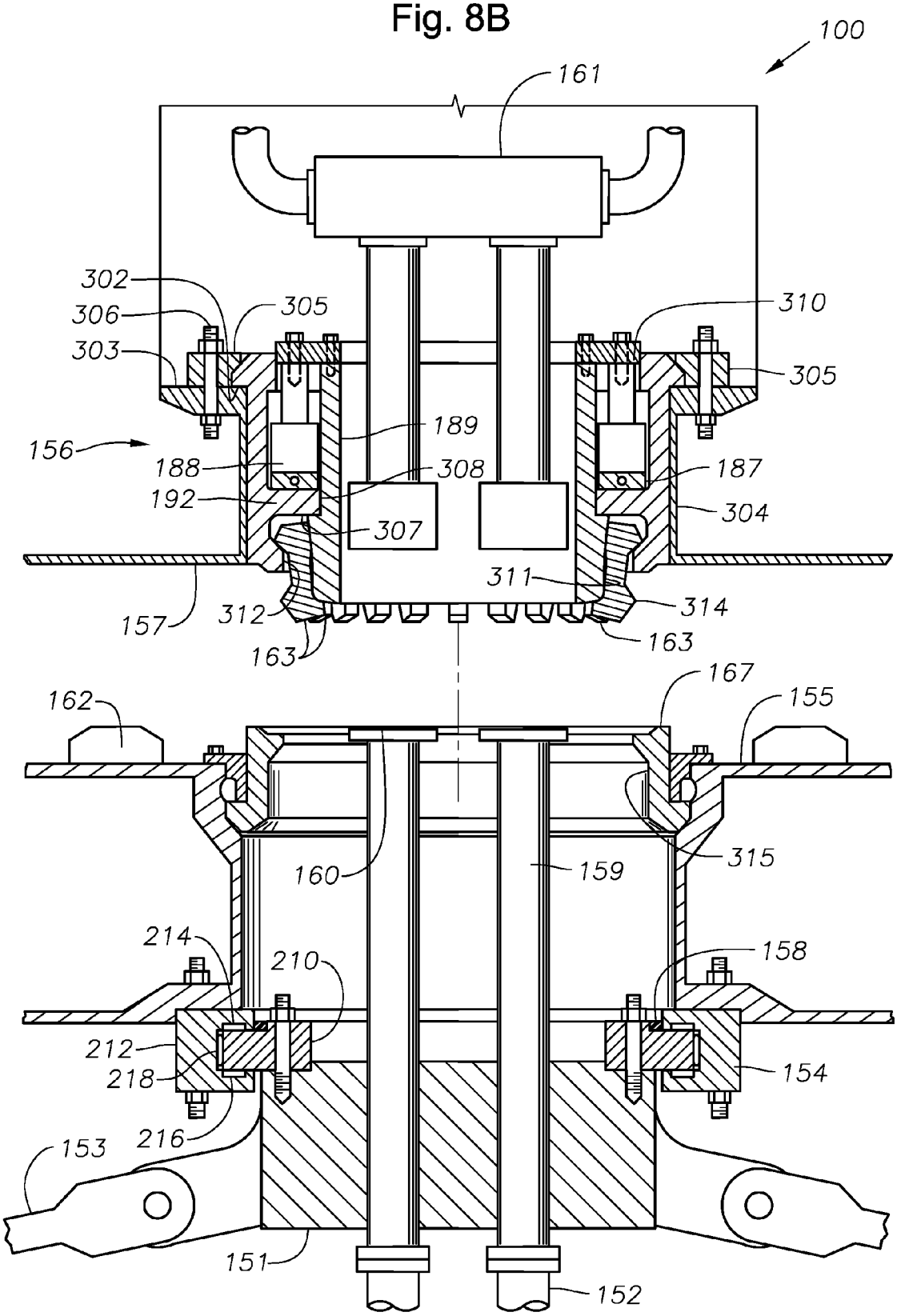
FIG. 8B is a side view in partial cross section of the mooring and fluid transfer system of FIG. 8A showing the structural connector disconnected from the buoy connector flange.

FIGS. 8A and 8B are side views in partial cross section of a first embodiment 100 of the invention in a mooring and fluid transfer system, shown in connected and disconnected states, respectively. Referring to FIGS. 8A and 8B, a detachable buoy 155 is provided with an upper structure 155U and a lower structure 155L which from a concentric buoyancy chamber. Preferably, the upper 155U and lower 155L structures include horizontal plates. A cylindrical shaft 168 is provided between upper and lower structures 155U, 155L. A common centerline 169 runs through the chain table 151, cylindrical shaft 168 and structural connector 156.

The detachable buoy 155 is mechanically connected to the keel of vessel 157 by structural connector 156, which includes collet segments 163 that are pushed outwardly for connection to buoy connector flange 167. Buoy 155 is rotatively fastened by axial/radial bearing assembly 154 to chain table 151, which is geostationarily moored to the seafloor by anchor legs 153. Bearing assembly 154 allows buoy 155 and vessel 157 to weathervane about chain table 151. Fenders 162 are located circumferentially around the buoy to allow controlled or cushioned contact between the buoy and the bottom 157B of the vessel 157 during connection. Fenders 162 are preferably, but not necessarily, made of rubber. A water seal 158 seals the vessel fluid transfer system (FTS) compartment so that it may be pumped dry for maintenance activities.

A flexible fluid conduit or riser 152 is suspended by buoy 155 to provide a fluid flow path between a subsea well, pipeline or component (not illustrated) and vessel 157 when moored to buoy 155. A flow line conductor 159 provides a flow path for product from the risers 152 to the fluid swivel 161 and is geostationary with chain table 151. A torque tube (not shown) is ideally attached between chain table 151 and the geostationary inner portion of fluid swivel 161 to drive the inner portion of the swivel. Conductor couplings 160 allow for disconnection of flow line conductors 159 so that lower portions of conductors 159 remains with buoy 155 and upper portions remains with vessel 157 when the buoy 155 is disconnected.

Buoy 155 is rotatively connected to chain table 151 by axial/radial bearing assembly 154. A water seal 158 prevents water ingress into the vessel FTS compartment after buoy 155 is connected to vessel 157. Bearing 154 includes a cylindrical bearing hub 210 that is rotatively captured by bearing ring 212. Bearing hub 210 slidingly rotates within bearing ring 212 by means of upper and lower axial bushing segments 214, 216 and radial bushing segments 218. Upper, lower and radial bushing segments 214, 216, 218 are captured between bearing ring 212 and bearing hub 210. Bushing segments 214, 216, 218 are preferably made of non-metallic low-friction self-lubricating bushing material, such as Orkot brand or a similar material. Such materials are readily available for submerged service exposed directly to the seawater.

Although axial/radial bearing assembly 154 is described where bearing ring 212 forms the groove and bearing hub 210 forms the tongue in a tongue and groove capturing arrangement, an opposite bearing arrangement may be used. In other words, bearing hub 210 may have a circumferential groove (not illustrated) instead of a circumferential tongue, which receives a tongue (not illustrated) formed by bearing ring 212.

Figure 9:
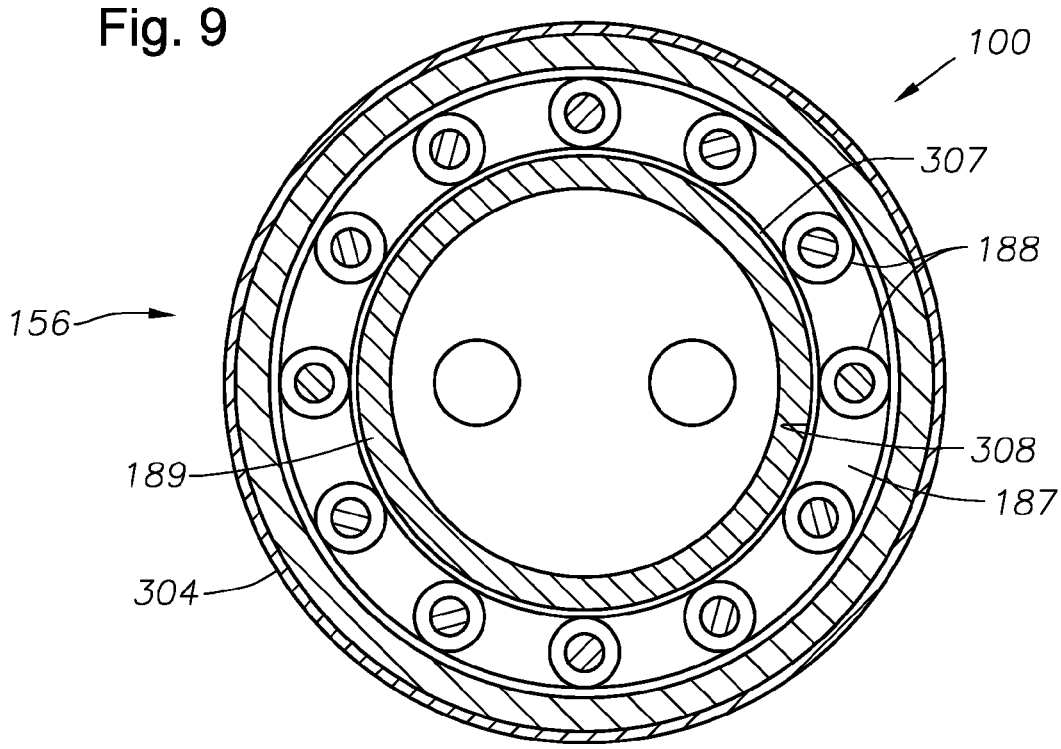
FIG. 9 is a top cross section view taken along lines 9-9 of FIG. 8A looking down on the mooring buoy and showing a circumferential arrangement of hydraulic actuators that operate the structural connector.
Figure 10:
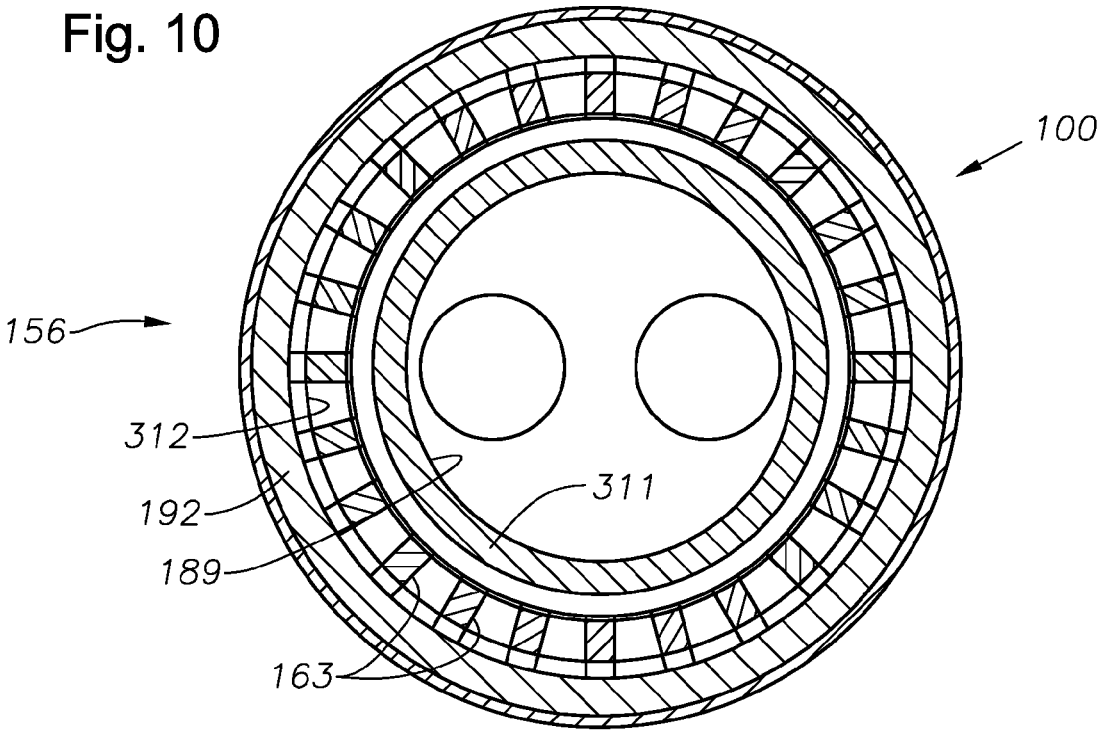
FIG. 10 is a top cross section view taken along lines 10-10 of FIG. 8A looking down on the mooring buoy and showing a circumferential arrangement of collet segments of the structural connector.

FIGS. 8A and 8B are side view cross sections of structural connector 156 and buoy connector flange 167, connected and disconnected respectively. FIGS. 9 and 10 are top view cross sections of structural connector 156. Referring to FIGS. 8A, 8B, 9 and 10 collectively, structural connector 156 preferably includes a cylindrical connector housing 192 having an upper flange 302 that vertically supports structural connector 156 on a lip 303 of a cylindrical vessel structural bulkhead 304. Housing 192 is secured in place by a cylindrical clamping ring 305 that is bolted to the cylindrical vessel bulkhead 304 by bolts 306. Housing 192 has an integral internal shelf 307 formed therein, the interior circumference 308 of which acts as a guide for movable connector sleeve 189 to slide axially therein.

The upper surface of housing shelf 307 supports a circular hydraulic pressure manifold 187 thereon. Manifold 187 supplies pressurized hydraulic fluid to a number of hydraulic piston/cylinder actuators 188 that are circumferentially arranged about connector sleeve 189 and seated on manifold 187. Preferably, twelve actuators 188 are used, but any suitable number may be used. The upper ends of actuators 188 are connected to connector sleeve 189 at an upper flange 310. A number of circumferentially arranged collet segments 163 are captured below shelf 307 between a lower interior lip 312 of housing 192 and a lower exterior taper 311 of connector sleeve 189. Ideally, two dozen collet segments 163 are used, but any suitable number may be used.

Each collet segment 163 has a profile that vertically captures it between lips 311, 312 of connector sleeve 189 and connector housing 192, respectively, yet forces the collet segment 163 to pivot in and out radially as connector sleeve 189 is moved up and down axially within housing 192 by actuators 188. The lower end of each collet segment 163 has a radially-outward facing lip 314 that engages a recess 315 in buoy connector flange 167. Thus, when connector sleeve 189 is moved downwardly, taper 311 forces collet segments 163 radially outward, securely dogging buoy connector flange 167 against housing 192. Similarly, when connector sleeve 189 is moved upwardly, collet segments 163 pivot radially inward, releasing connector flange 167 from vessel 157.

The structural connector 156 and the connector flange 167 are arranged and dimensional so that a space 200 is formed between the bottom 157B of the vessel 157 and the plate 155U. Such space 200 provides the place for fenders 162 and metal-to-metal shoes 110 described below.

Although structural connector 156 is described and illustrated herein as generally cylindrical, it is not limited to a round or circular cylindrical configuration. For example, octagonal, hexagonal, or even a square-shaped structural connector 156 may be used.

Figure 11:
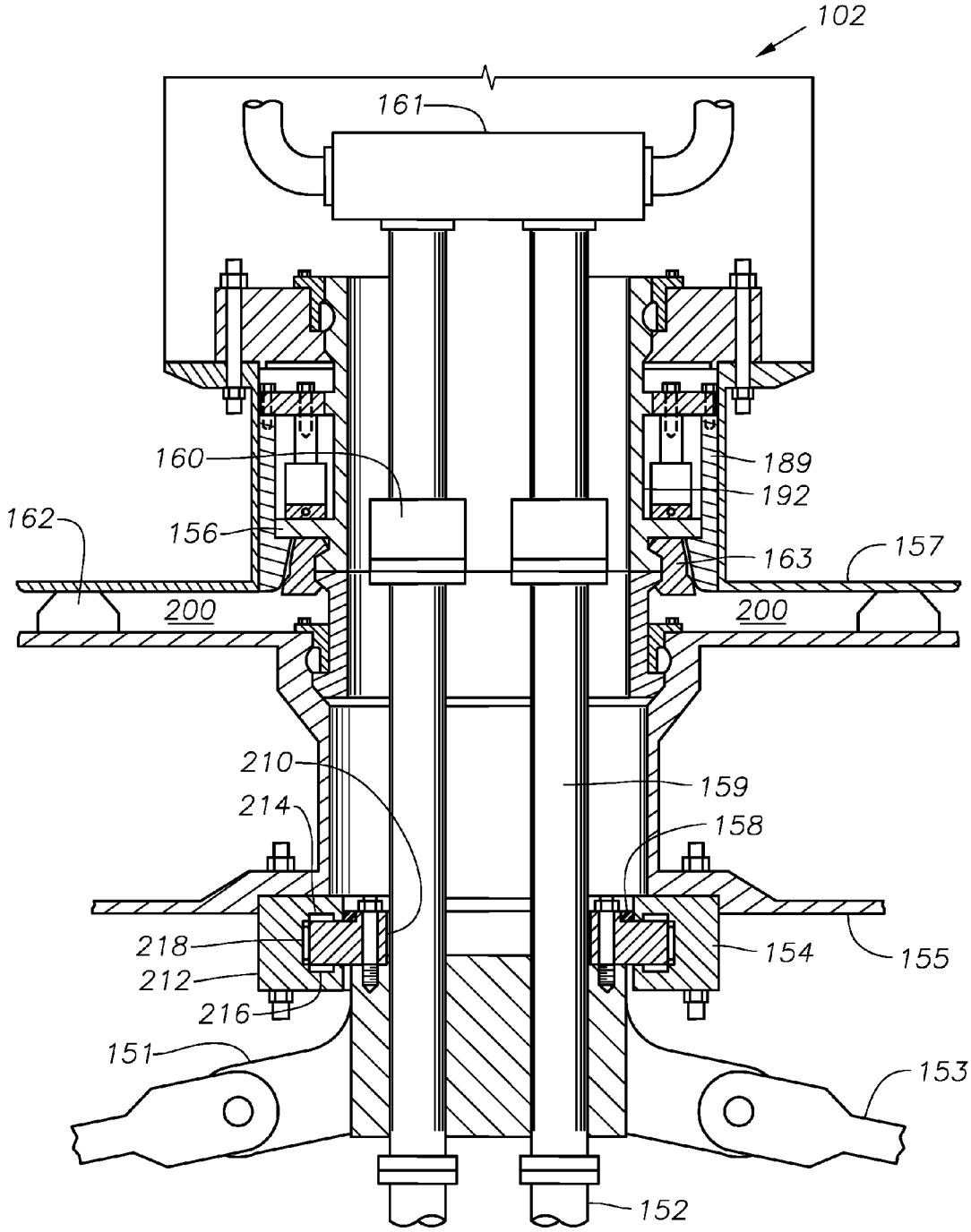
FIG. 11 is a side view in partial cross section of a mooring and fluid transfer system according to an alternative embodiment of the invention where the collet segments clamp against the buoy connector flange in a radially inward direction as opposed to the embodiment of FIG. 8A, where the collet segments clamp against the buoy connector flange in a radially outward direction.

FIG. 11 shows a side view in partial cross section of a mooring and fluid transfer system 102 of a second embodiment of the invention. The system 102 of FIG. 11 is substantially identical to the system 100 of FIG. 8A except that the collet segments are pushed inwardly for connection and outwardly for disconnection. Movable connector sleeve 189 is coaxially disposed outside of housing 192 rather than being disposed coaxially within housing 192, as shown in FIG. 8A.

Figure 12:
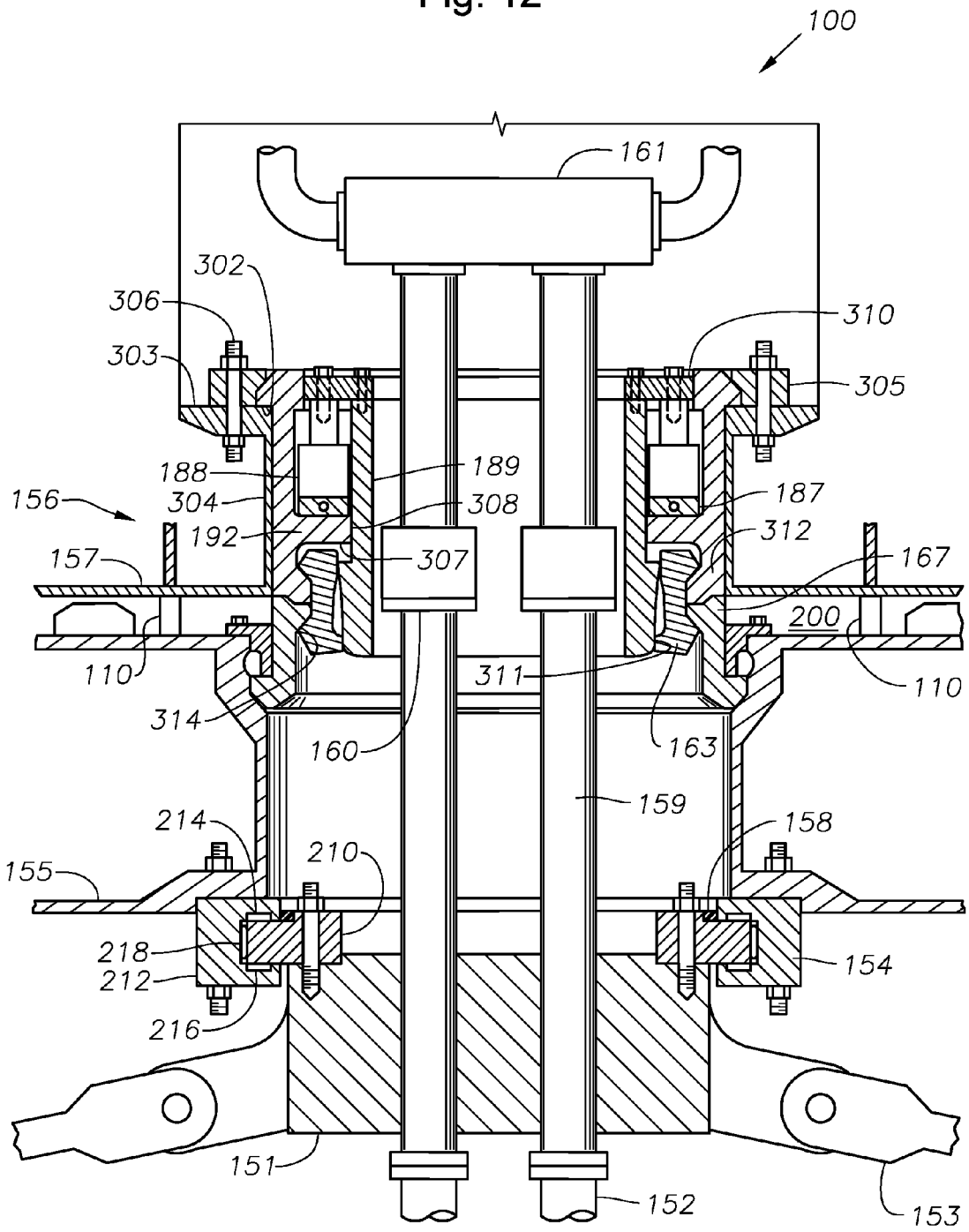
FIG. 12 is a side view in partial cross section of the mooring and fluid transfer system of FIG. 8A showing optional metal-to-metal contact shoes between the top of the buoy and the vessel keel.

FIG. 12 illustrates the mooring and fluid transfer system 100 of FIG. 8A equipped with optional metal-to-metal contact shoes 110 disposed between the top of the buoy 155 and the bottom of vessel 157. The contact shoes 110 increase the diameter of the load path between buoy 155 and vessel 157, thereby reducing the pull-in load requirements and the effective load on structural connector 156. The metal-to-metal contact interface allows structural connector 156 to develop external structural preload between buoy 155 and vessel 157. This preload reduces the fatigue sensitivity of structural connector 156 and surrounding components. The metal-to-metal contact option is shown with the mooring and fluid transfer system illustrated in FIG. 12 (and in FIG. 13), but it may be used with all of the embodiments disclosed herein.

Figure 13:
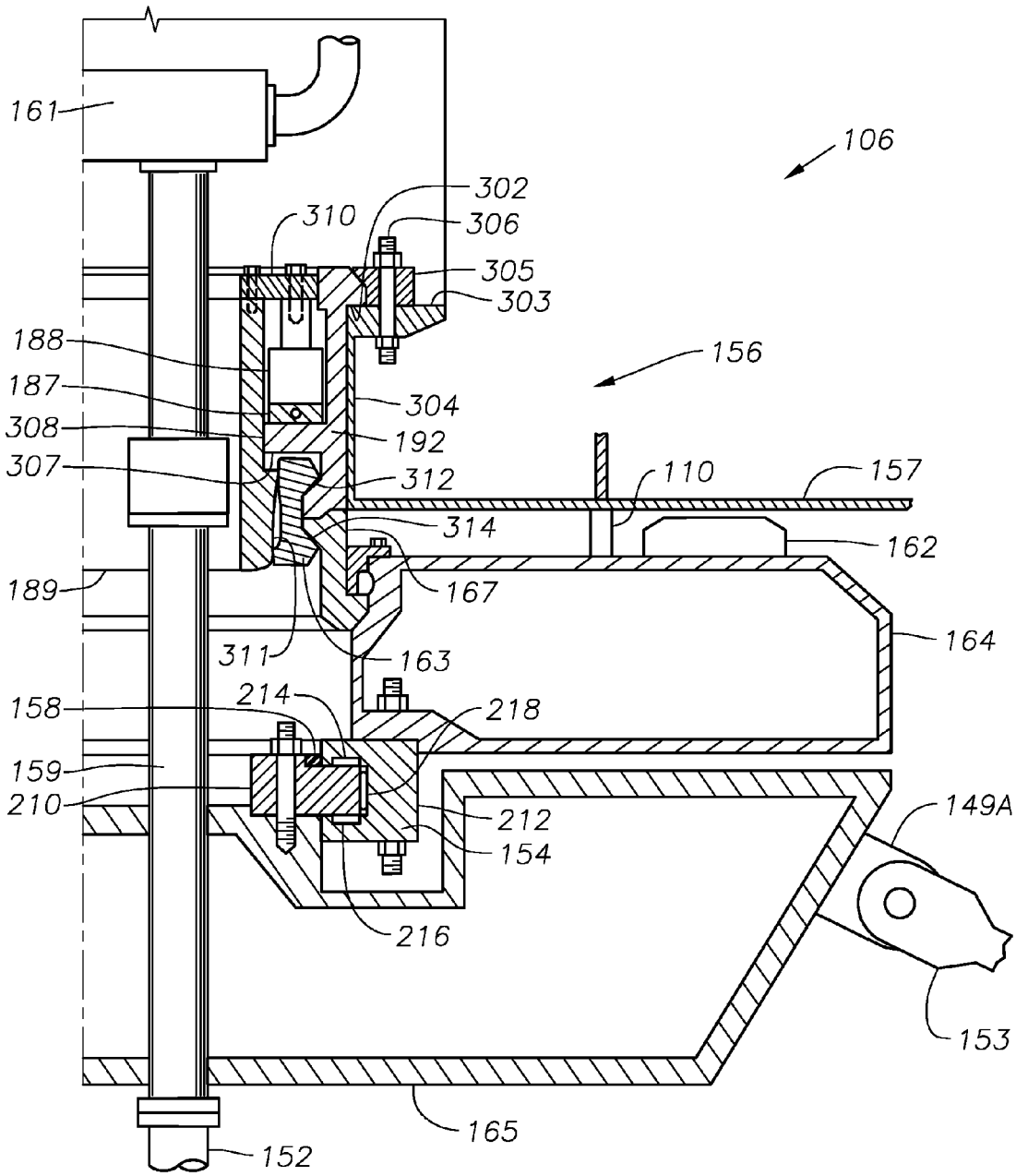
FIG. 13 is an enlarged side view in partial cross section of one half of a mooring and fluid transfer system according to an alternative embodiment showing a buoy divided into upper and lower halves, with the upper buoy half rotationally coupled to the lower buoy half, where the lower buoy functions as a chain table by connection of anchor legs thereto.

FIG. 13 shows a side view in partial cross section of one half of a mooring and fluid transfer system 106 according to a third embodiment of the invention. The system 106 of FIG. 13 is similar to the system 100 of FIG. 8A except that the buoy is formed of two individual sections: an upper buoy 164 and a lower buoy/chain table 165. Axial/radial bearing 154 rotatively connects upper buoy 164 to lower buoy/chain table 165 to allow the upper buoy 164 and vessel 157 to weathervane. This arrangement allows the chain table anchor leg attachment points or ears 149A to be placed about a larger diameter, thereby increasing the yaw stiffness of the mooring system. The arrangement of FIG. 13 also allows anchor leg connection 153 to be closer in elevation to bearing assembly 154, and bearing assembly 154 to be closer in elevation to structural connector 156, thus reducing the moment loading on bearing assembly 154 and structural connector 156. Like the embodiment of FIG. 12, the bottom of the vessel includes optional metal-to-metal contact shoes 110 to allow for external structural preload and to reduce pull-in loads of buoy 164, 165.

Figure 14:
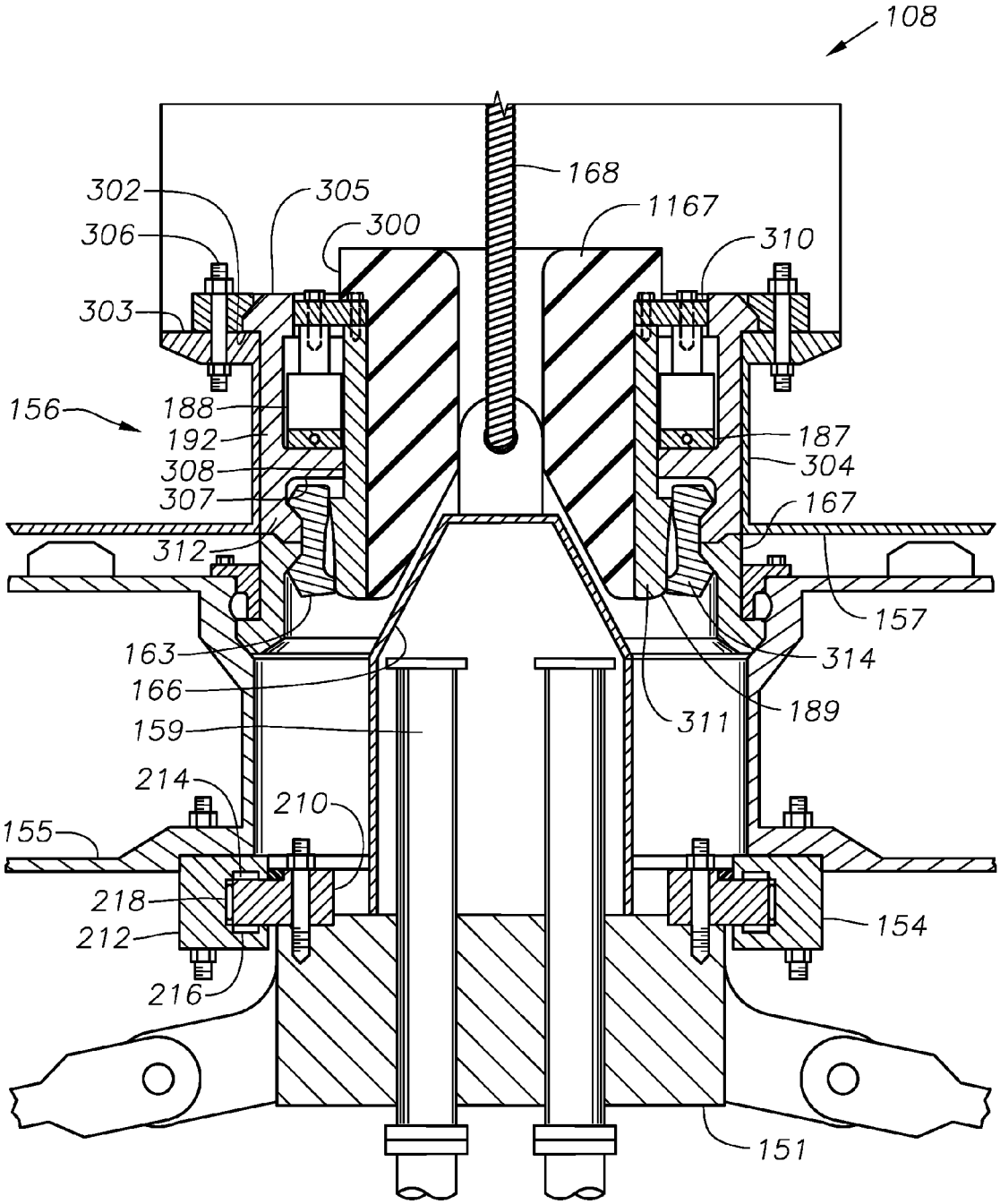
FIG. 14 is a side view in partial cross section of the mooring and fluid transfer system of FIG. 8A showing a retrieval guide sleeve and the mooring buoy supported by a hawser, having just been retrieved to the ship.

FIG. 14 is a side view in partial cross section that illustrates a pull-in arrangement 108 for the embodiment of FIG. 8A, with mooring buoy 155 supported by a hawser 168, as if just retrieved to vessel 157. However, the pull-in arrangement is applicable to all embodiments disclosed herein. Fluid swivel 161 (FIG. 8A) has been disconnected and moved aside. A pull-in adapter/protector 166 is temporarily attached to chain table 151 to protect fluid conductors 159. Pull-in adapter/protector 166 allows for attachment of pull-in hawser 168 for pulling buoy 155 to vessel 157 for connection thereto. A pull-in insert or retrieval guide unit 1167 is temporarily inserted into connector sleeve 189 to guide pull-in hawser 168 and pull-in adapter 166 into connector sleeve 189 during mating of buoy 155 to vessel 157. Retrieval guide unit 167 centers hawser 168 and provides for centralized alignment of pull-in adapter 166 as buoy 155 approaches vessel 157. Retrieval guide unit 167 is preferably integrated with rubber inserts to allow impact loading by pull-in adapter 166. Retrieval guide unit 167 has an upper flange 300 that vertically supports it on upper flange 310. After buoy 155 is fully connected, retrieval guide 167 is removed in preparation for connecting fluid conductors 169 to fluid swivel 161.

While some embodiments of the invention have been illustrated in detail, the invention is not limited to the embodiments shown; modifications and adaptations of the above embodiment may occur to those skilled in the art. Such modifications and adaptations are in the spirit and scope of the invention as set forth herein.

What is claimed is:

1. A disconnectable mooring arrangement for a vessel (157) comprising:

a buoy (155) having an upper structure (155U) and a lower structure (155L), a generally vertical shaft (168) defined between said upper structure and said lower structure;

a chain table (151) rotatively coupled to said buoy (155) by an axial/radial bearing assembly (154) mounted to said lower structure (155L) of said buoy (155), said chain table (151) having anchor legs (153) attached thereto capable of anchoring said chain table (151) to a sea floor, whereby said buoy (155) is free to rotate about said chain table (151) when said anchor legs (153) are anchored to said sea floor;

a connector flange (167) having a lower part secured within said vertical shaft (168) and an upper part extending above said upper structure (155U);

a structural connector (156) mounted on said vessel (157) and arranged and designed to releasably connect to said upper part of said connector flange (167), whereby connection of said structural connector (156) to said connector flange (167) moors said vessel (157) to the sea floor while allowing said vessel (157) and said buoy (155) to weathervane about said chain table (151) and wherein said upper structure (155U) of said buoy (155) is designed to be substantially parallel to a bottom surface (157B) of the vessel (157), said connector flange (167) and said structural connector (156) being arranged and dimensioned to define a vertical space (200) between said upper structure (155U) and said bottom surface (157B) of the vessel (157) when said structural connector (156) is connected to said connector flange (167), a center line (169) is defined within said structural connector (156), said connector flange (167), said buoy (155) and said chain table (151), when connected together, the arrangement further comprising metal-to-metal contact shoes (110) circumferentially connected about said center line (169) and facing downwardly from said bottom surface of said vessel (157).

2. The arrangement of claim 1 further comprising fenders (162) circumferentially mounted on top of said upper structure (155U), said fenders (162) arranged and designed to provide cushioned contact between the buoy (155) and the bottom surface (157B) of the vessel (157) during connection of the buoy (155) with the vessel (157).

3. The arrangement of claim 1 wherein, said structural connector (156) is a hydraulic collet connector with collet segments (163) that are forced outwardly for connection with said connector flange (167) and forced inwardly for disconnection.

4. The arrangement of claim 1 wherein, said structural connector (156) is a hydraulic collet connector with collet segments (163) that are forced inwardly for connection with said connector flange (167) and forced outwardly for disconnection.

5. The arrangement of claim 1 wherein, said chain table is non-buoyant and has ears (149) for connection of said anchor legs (153) which are substantially vertically positioned beneath said axial/radial bearing assembly.

6. The arrangement of claim 1 wherein said chain table is a buoyant structure (165).

7. The arrangement of claim 6 wherein, said buoyant structure (165) has ears (149A) mounted thereon for connection of said anchor legs (153), said ears (149) being positioned radially outwardly from said axial/radial bearing assembly (154).

8. A disconnectable mooring arrangement for a vessel (157) comprising:

a buoy (155) having an upper structure (155U) and a lower structure (155L), a generally vertical shaft (168) defined between said upper structure and said lower structure;

a chain table (151) rotatively coupled to said buoy (155) by an axial/radial bearing assembly (154) mounted to said lower structure (155L) of said buoy (155), said chain table (151) having anchor legs (153) attached thereto capable of anchoring said chain table (151) to a sea floor, whereby said buoy (155) is free to rotate about said chain table (151) when said anchor legs (153) are anchored to said sea floor, a connector flange (167) having a lower part secured within said vertical shaft (168) and an upper part extending above said upper structure (155U), a structural connector (156) mounted on said vessel (157) and arranged and designed to releasably connect to said upper part of said connector flange (167), whereby connection of said structural connector (156) to said connector flange (167) moors said vessel (157) to the sea floor while allowing said vessel (157) and said buoy (155) to weathervane about said chain table (151), the arrangement of further comprising, an adapter/protector (166) placed within said cylindrical shaft (168) and selectively secured to said chain table (151), a pull-in hawser (168) secured to said adapter/protector (166), said pull-in hawser arranged and designed for pulling said buoy (155) and said chain table (151) upwardly into engagement of said connector flange (167) with said structural connector (156), and a retrieval guide unit (1167) selectively insertable within said structural connector (156), said guide unit (1167) being arranged and designed to guide said pull-in hawser (168) and said pull-in adapter (166) into said structural connector (156) during mating of said buoy (155) to vessel (157).

9. A disconnectable mooring arrangement for a vessel (157) comprising, a buoy (155) having an upper structure (155U) and a lower structure (155L) and a connector flange (167) mounted thereon, a structural connector (156) mounted on said vessel (157) and arranged and designed to releaseably connect said connector flange (167) of said buoy (155) to said vessel (157), said upper structure (155U) of said buoy (155) designed to be substantially parallel to a bottom surface (157B) of the vessel (157), said connector flange (167) and said structural connector (156) arranged and dimensioned to define a vertical space (200) between said upper structure (155U) and said bottom surface (157B) of the vessel (157) when the structural connector (156) is connected to said connector flange (167), and metal-to-metal shoes (110) connected to and facing downwardly from said bottom surface of said vessel (157) into said vertical space (200) to provide contact between said upper structure (155U) and said bottom surface (157) of the vessel (157) when the structure connector (156) is connected to said connector flange (167).

10. A disconnectable mooring arrangement comprising, a buoy (155) having a substantially horizontal top surface (155U) with a vertical cylindrical opening in the top surface (155U), with the cylindrical opening through the said horizontal top surface (155U) arranged to be substantially orthogonal to said horizontal top surface (155U), a vessel (157) having a keel with a substantially horizontal bottom surface portion, a structural connector (156) mounted in an opening of said horizontal bottom surface portion that is substantially orthogonal to said horizontal bottom surface portion, a connector flange (167) having a lower part secured within said vertical cylindrical opening of said buoy and an upper part extending above said substantially horizontal top surface of said buoy (155), said structural connector (156) arranged and designed to releaseably connect to said upper part of said connector flange (167), said substantially horizontal top surface (155U) of said buoy (155) and said substantially horizontal bottom surface portion of said vessel (157) being arranged and designed such that when said structural connector (156) is connected to said upper part of said connector flange (167), said buoy (155) top surface (155U) and the upper most portion of said upper part of said connector flange (167) remains below any portion of said keel of said vessel, a chain table (151) rotatively coupled to said buoy (155), said chain table having anchor legs (153) attached thereto capable of anchoring said chain table to a sea floor, whereby said buoy (155) is free to rotate about said chain table when said anchor legs are anchored to said sea floor, whereby, connection of said structural connector (156) to said connector flange (167) moors said vessel (157) and said buoy (155) to the sea floor allowing said vessel (157) and said buoy (155) to weathervane about said chain table.

* * * * *